US009469475B2

(12) United States Patent
McDade et al.

(10) Patent No.: US 9,469,475 B2
(45) Date of Patent: Oct. 18, 2016

(54) GARBAGE CAN RETENTION CLIP

(71) Applicants: Theresa Lynn McDade, Peoria, IL (US); Matthew Joseph McDade, Peoria, IL (US); Phillip Randal Poehlman, Washington, IL (US)

(72) Inventors: Theresa Lynn McDade, Peoria, IL (US); Matthew Joseph McDade, Peoria, IL (US); Phillip Randal Poehlman, Washington, IL (US)

(73) Assignee: Matthew J. McDade, Peoria, IL (US)

( * ) Notice: Subject to any disclaimer, the term of this patent is extended or adjusted under 35 U.S.C. 154(b) by 0 days.

(21) Appl. No.: 14/274,996

(22) Filed: May 12, 2014

(65) Prior Publication Data

US 2016/0052714 A1 Feb. 25, 2016

(51) Int. Cl.
*B65D 43/22* (2006.01)
*B65F 1/14* (2006.01)

(52) U.S. Cl.
CPC ..... *B65F 1/1615* (2013.01); *B65D 43/22* (2013.01); *B65D 2251/1016* (2013.01); *B65D 2251/1058* (2013.01)

(58) Field of Classification Search
CPC ..... B65F 1/1615; B65D 43/22; B65D 2251/1016; B65D 2251/1058
USPC ..... 220/318, 908, 315, 324, 833–835; 24/615, 625
See application file for complete search history.

(56) References Cited

U.S. PATENT DOCUMENTS 6,880,717 B1 * 4/2005 O'Conor ..... B65F 1/1615 220/315
2007/0062012 A1 * 3/2007 Caison ..... A44B 11/263 24/302
2013/0312227 A1 * 11/2013 Wheelwright ..... A44B 11/2592 24/16 PB

* cited by examiner

*Primary Examiner* — James N Smalley
(74) *Attorney, Agent, or Firm* — Adam K. Sacharoff; Much Shelist

(57) ABSTRACT

The invention includes two interconnecting side release buckles configured to releasable connect to each other. A first webbing is secured in a loop to one release buckle, while a second webbing is secured around the other release buckle. A cable tie is positioned through the loop in the first webbing and inserted through openings in the hinged lid such that the cable tie can be tied about itself to secure the release buckle to the hinged lid. A fastener is secured through an eyelet in the second webbing and secured to a region on the trash can. Upon securing one of the side release buckles to the trash can and the other side release buckle to hinged lid, the side release buckles may be connected to each other to secure the trash can to the hinged lid and released to permit the hinged lid to open.

2 Claims, 5 Drawing Sheets

GARBAGE CAN RETENTION CLIP

BACKGROUND OF THE INVENTION

The present invention relates to a garbage can retention clip for securing a hinged lid trash can against animal entry.

BRIEF SUMMARY OF THE INVENTION

The invention attaches to a hinged lid trash can. The invention holds the hinged lid trash can dosed. The invention can be released by an individual for access and trash disposal while keeping the lid securely closed against animals.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
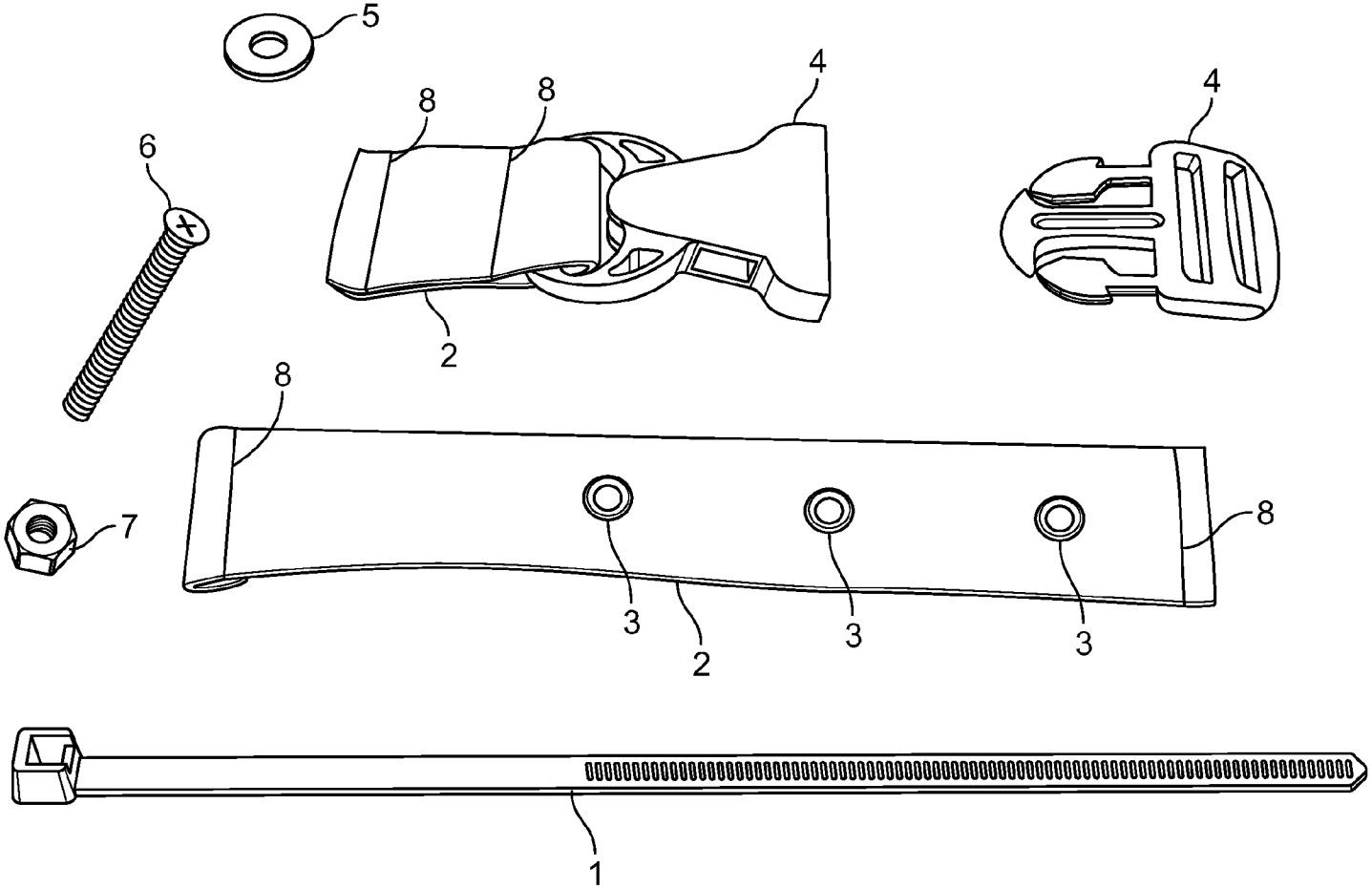
FIG. 1 is a view of all the parts that make up the Invention prior to assembly.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

In FIG. 1 the parts are 1 cable tie, 2 polyester ebbing with end seams sewn with 8 UV polyester thread, 3 metal eyelets installed in the 2 polyester webbing, 4 plastic side release buckle with 2 polyester webbing attached with an 8 UV polyester thread seam, 5 metal washer, 6 metal bolt and 7 metal nut.

Figure 2:
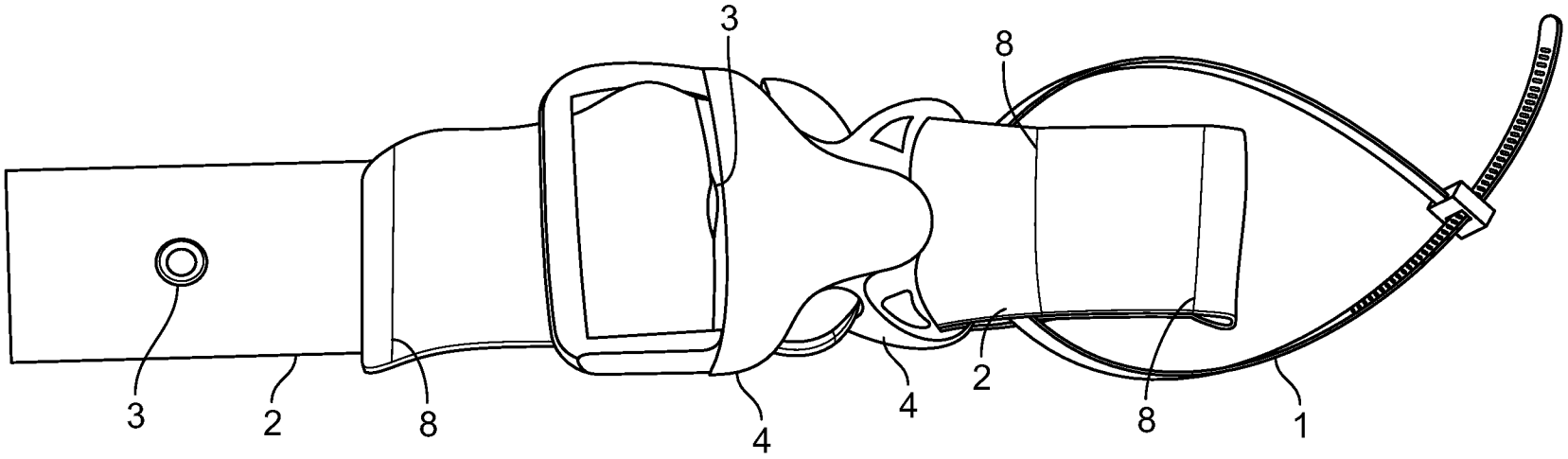
FIG. 2 is a top view of the Invention with all parts assembled.

FIG. 2 is a top view of the Invention fully assembled in the closed position. In this view the 8 polyester webbing with the three installed 3 eyelets is woven into the adjustable male side of the 4 side release buckle. This male side of the 4 side release buckle is then inserted into the female side of the 4 side release buckle. A length of 2 polyester webbing is looped through the loop on the female side of the 4 side release buckle then sewn with 8 UV polyester thread to permanently attach the 4 side release buckle to the 2 polyester webbing. The 2 polyester webbing, that is attached to the female 4 side release buckle, has an end seam sewn in it with 8 UV polyester thread to deter fraying of the 2 polyester webbing. A 1 cable tie is looped through the seam created with 8 UV polyester thread to attach the female side and then looped through the holes on the trash can to semi-permanently attach the female side of the Invention to the trash can as shown in FIG. 5.

Figure 3:
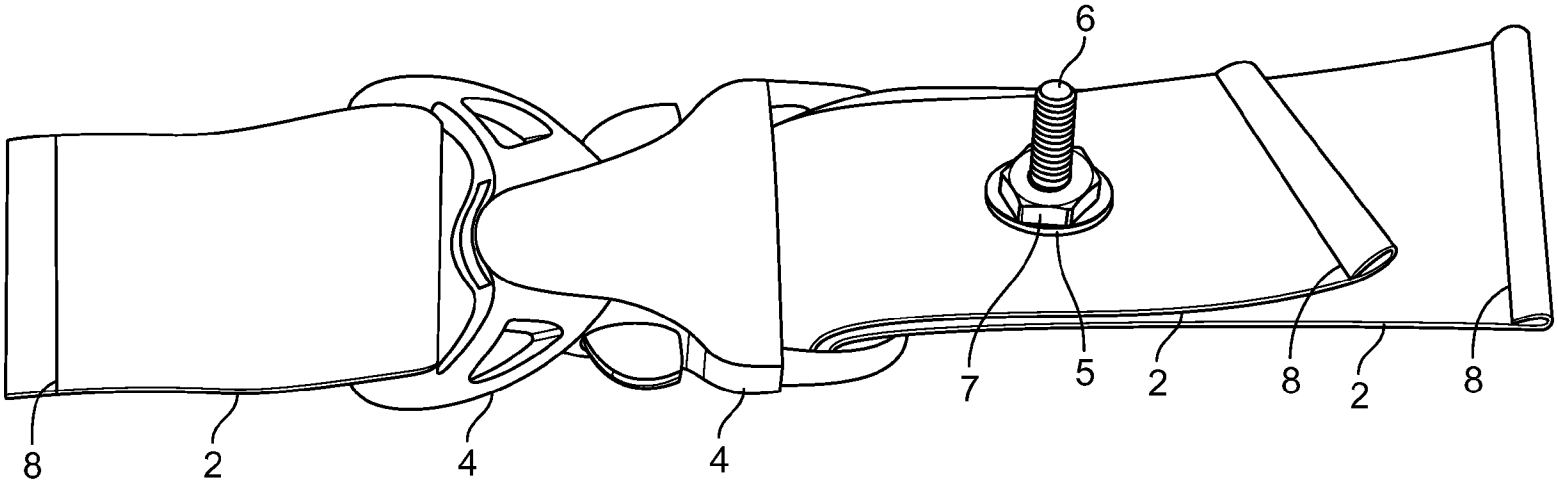
FIG. 3 is a bottom view of the Invention with all parts assembled.

FIG. 3 is a bottom view of the Invention fully assembled in the closed position. In this view is depicted the placement of the 6 metal bolt through one of the three 3 metal eyelets in the 2 polyester webbing. The 5 metal washer and 7 metal nut are then placed on the 6 metal bolt to secure the male side of the 4 side release buckle in holes on the hinged lid trash can as shown in FIG. 5.

Figure 4:
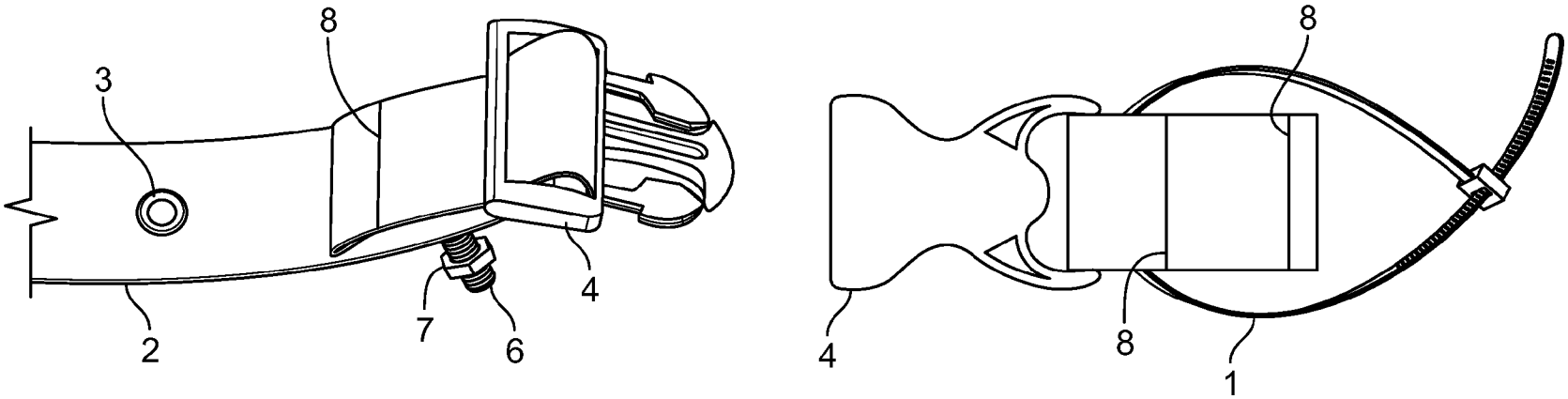
FIG. 4 is a top view of the Invention with all parts assembled. In this view the side release buckle has been released; and 2

FIG. 4 is a top view of the Invention fully assembled in the open position.

Figure 5:
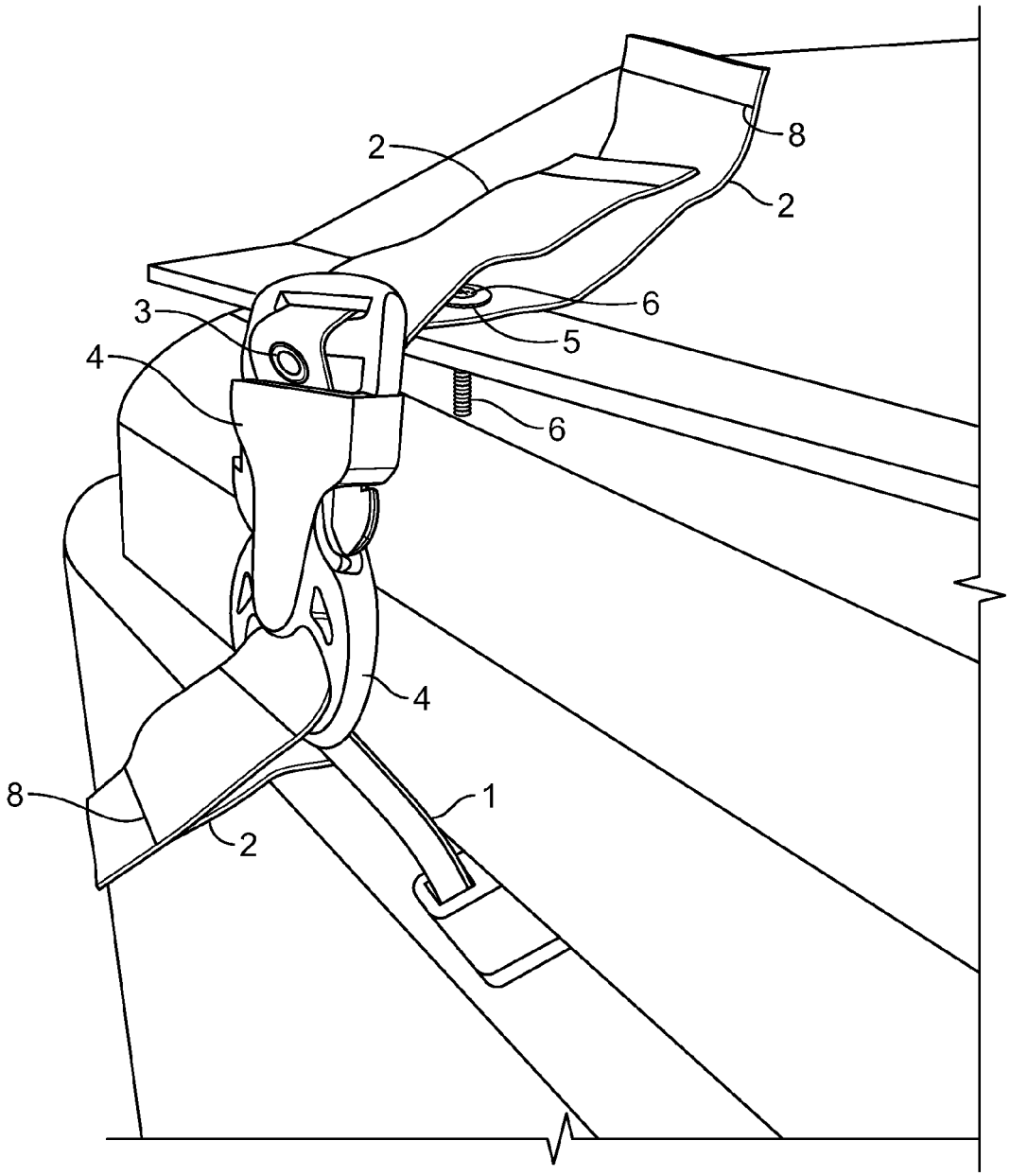
FIG. 5 is a side view of the Invention with all parts assembled and attached to a hinged lid trash can.

FIG. 5 is a side view of the Invention fully assembled and attached to a hinged lid trash can. The female side of the 4 side release buckle is attached to the trash can with the 1 cable tie running through the seam created when attaching the 4 side release buckle to the 2 polyester webbing and then running it through preexisting holes in the trash can and securing. The male side of the 4 side release buckle is attached to the hinged lids preexisting holes using the 6 metal bolt placed through the 3 metal eyelets installed in the 2 polyester webbing. The 6 metal bolt is then secured to the hinged lid using the 5 metal washer and 7 metal nut. By placing the male side of the 4 side release buckle into the female side of the 4 side release buckle and tightening the adjustable 2 polyester webbing on the male side of the 4 side release buckle the Invention will now hold your hinged lid securely shut against animal entry.

In one aspect of the present invention there is provided a device for securing a hinged lid to a trash can preventing animals from gaining entry therein. The device is defined to include two interconnecting side release buckles having first ends configured to releasable connect to each other and having second opposing ends. A first webbing is secured in a loop about one of the opposing ends of one of the side release buckles. This allows the first webbing to be permanently secured about the end of the release buckle. A second webbing is provided and include at least one eyelet formed therethrough along the length of the webbing. The second webbing is secured around the other opposing end of the other side release buckle. A cable tie is positioned through the loop in the first webbing and inserted through openings in a part of the hinged lid (typically opposite of the hinge in the trash can) such that the cable tie can be tied about itself to secure the first webbing to the part of the hinged lid. A fastener is then secured through the eyelet in the second webbing and secured to a region on the trash can. Therefore, upon securing one of the side release buckles to the trash can and the other side release buckle to hinged lid, the side release buckles may be connected to each other to secure the trash can to the hinged lid and released to permit the hinged lid to open.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A device for securing a hinged lid to a trash can preventing animals from gaining entry therein, comprising two interconnecting side release buckles having first ends configured to releasable connect to each other and having second opposing ends;

a first webbing secured in a loop about one of the opposing ends of one of the side release buckles, wherein the first webbing is permanently secured about the end of the release buckle;

a second webbing having at least one eyelet formed therethrough along the length of the webbing, the second webbing secured around the other opposing end of the other side release buckle;

a cable tie being positioned through the loop in the first webbing and inserted through openings in a part of the hinged lid such that the cable tie can be tied about itself to secure the side release buckle secured to the first webbing to the part of the hinged lid; and a fastener secured through the eyelet in the second webbing and secured to a region on the trash can to secure the other side release buckle secured to the second webbing to the region on the trash can; wherein upon securing one of the side release buckles to the trash can and the other side release buckle to hinged lid, the side release buckles may be connected to each other to secure the trash can to the hinged lid and released to permit the hinged lid to open.

2. The device of claim 1, wherein the second webbing includes a plurality of eyelets to allow the release buckle secured thereto to be configured for adjustment when securing to the region on the trash can.

* * * * *